US006428346B1

(12) United States Patent
Torii

(10) Patent No.: US 6,428,346 B1
(45) Date of Patent: Aug. 6, 2002

(54) HALF FIT PREVENTIVE CONNECTOR

(75) Inventor: Chieko Torii, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/865,669

(22) Filed: May 29, 2001

(30) Foreign Application Priority Data

Jun. 6, 2000 (JP) ..... 2000-169254

(51) Int. Cl.[7] ..... H01B 3/00
(52) U.S. Cl. ..... 439/489; 439/354; 439/382
(58) Field of Search ..... 439/354, 382, 439/385, 489, 923

(56) References Cited

U.S. PATENT DOCUMENTS

| | | | | |
|---|---|---|---|---|
| 5,628,648 A | * | 5/1997 | Higgins, Jr. et al. | 439/489 |
| 5,938,466 A | * | 8/1999 | Suzuki et al. | 439/352 |
| 6,019,629 A | * | 2/2000 | Ito et al. | 439/489 |
| 6,206,717 B1 | * | 3/2001 | Matsumoto | 439/354 |
| 6,254,424 B1 | * | 7/2001 | Murakami et al. | 439/489 |
| 6,341,974 B1 | * | 1/2002 | Konoya | 439/352 |
| 6,358,081 B1 | * | 3/2002 | Saka et al. | 439/352 |
| 6,361,347 B1 | * | 3/2002 | Murakami et al. | 439/352 |

FOREIGN PATENT DOCUMENTS

| | | | |
|---|---|---|---|
| JP | 3-269965 | 12/1991 | H01R/13/64 |
| JP | 4-24277 | 2/1992 | H01R/13/639 |
| JP | 4-306575 | 10/1992 | H01R/13/62 |
| JP | 9-55261 | 2/1997 | H01R/13/64 |

OTHER PUBLICATIONS

Patent Abstract of Japan, 03–269965, Dec. 2, 1991.
Patent Abstract of Japan, 04–306575, Oct. 29, 1992.
Patent Abstract of Japan, 09–055261, Feb. 25, 1997.

* cited by examiner

*Primary Examiner*—Brian Sircus
*Assistant Examiner*—Thanh-Tam Le
(74) *Attorney, Agent, or Firm*—Sughrue Mion, PLLC

(57) ABSTRACT

In the half fit preventive connector of the invention, of two housings respectively forming a set of male and female connectors to be fitted with each other, a spring member is mounded on one housing due to the repulsion force generated by the spring member, the male and female connectors can be prevented from being imperfectly fitted with each other. The spring member includes a support arm rotatable in the connector fitting direction and a resilient piece supported inwardly on the free end portion of the support arm. Also, a spring contact projection is formed on the front end portion of the side surface of the other housing. The spring contact projection includes in the rear portion thereof an escape space through which the resilient piece can return back its free state when the male and female connectors are perfectly fitted with each other.

3 Claims, 11 Drawing Sheets

PRIOR ART

PRIOR ART

PRIOR ART

PRIOR ART

HALF FIT PREVENTIVE CONNECTOR

CROSS REFERENCE TO RELATED APPLICATIONS

The present invention is based on Japanese Patent Application No. 2000-169254, which is incorporated herein by reference.

BACKGROUND OF THE INVENTION

1. Field of the Invention

The present invention relates to a half fit preventive connector which not only can prevent a set of male and female connectors to be fitted and connected with each other from being imperfectly fitted with each other using the repulsion force of a spring member mounted on at least one of the connector housings of the male and female connectors but also can prevent the spring member from being fatigued using a simple structure.

2. Description of the Related Art

Conventionally, there are known various kinds of half fit preventive connectors which prevent the imperfect fit between the male and female connectors using the repulsion force of a spring member mounted on a connector housing (which is hereinafter referred to as a housing simply). For example, as shown in FIGS. 8 to 13, there is known a half fit preventive connector which is disclosed in JP-U-4-24277. According to a conventional half fit preventive connector shown FIGS. 8 and 9, in the center of the bottom portion of a housing 55 of a female connector 53 which is one of a set of male and female connectors 52, 53 to be fitted and connected with each other, there is mounted a spring member 56. That is, the present half fit preventive connector 51 prevents the imperfect fit between the male and female connectors 52 and 53 due to the repulsion force of the spring member 56.

And, the male connector 52 includes a lock arm 60 which not only is supported on a support pillar 59 erected on the leading end portion of a housing 54 but also includes a securing projection 61 disposed on the intermediate portion of the upper portion thereof and a pair of pressing parts 62 disposed on the rear end portion thereof. Also, the female connector 53 includes a slide plate 65 which is supported on the upper portion of the front end of the housing 55 and allows the securing projection 61 to slide onto the lower surface thereof and, in the rear end portion of the slide plate 65, there is formed a securing groove 66 to which the securing projection 61 can be secured.

Thus, the present half fit preventive connector 51, when fitting together the male and female connectors 52 and 53, cooperates together with the spring member 56 in causing the lock arm 60 to flex to thereby secure the securing projection 61 to the securing groove 66 of the female connector 53, so that the male and female connectors 52 and 53 can b[0085] perfectly fitted with each other.

Also, the spring member 56, as shown in FIG. 10, includes as a base portion thereof an elastically flexible part 67 which is formed of a coiled spring; and, the elastically flexible part 67 includes a support arm 57 which is extended from one end thereof obliquely backward in a linear manner and can be rotated in the fitting direction of the male and female connectors 52 and 53. And, in the spring member 56, there is disposed a resilient piece 58 which is curved from the support arm 57 so as to return toward the base portion of the elastically flexible part 67.

And, the spring member 56 further includes a mounting arm 68 which not only is extended from the other end thereof backward in a linear manner but also includes a reversed-pawl-shaped projection 69. The mounting arm 68 is inserted into a mounting hole 70 of a mounting part 71 provided in one housing 55 and retained by the reversed-pawl-shaped projection 69 so as to prevent removal of the mounting arm 68 from the mounting part 71.

And, In the housing 54 of the male connector 52, there is formed a terminal storage chamber 63 for storing a terminal such as a female-type terminal and, in the front-end opening portion of the terminal storage chamber 63, there is formed a spring contact portion 64 with which the resilient piece 58 can be contacted. By the way, in the rear portion of the housing 55 of the female connector 53, there is formed a terminal storage chamber 72 for storing a terminal such as a male-type terminal.

In the above-structured half fit preventive connector 51, as shown in FIG. 8, firstly, the spring member 56 is mounted onto the mounting part 71 disposed within one housing 55 and, after then, a male-type terminal with the end portion of a covered electric wire connected thereto is inserted and mounted into the terminal storage chamber 72. Also, into the terminal storage chamber 63 formed within the other housing 54, there is inserted and mounted a female-type terminal to which the end portion of a covered electric wire is connected.

Next, as shown in FIG. 11, the male and female connectors 52 and 53 are opposed to each other and their mutual fitting operation is started. Specifically, the housing 54 of the male connector 52 is fitted into the housing 55 of the female connector 53 and the resilient piece 58 including the support arm 57 of the spring member 56 is brought into contact with the spring contact portion 64 of the housing 54. As a result, the support arm 57 is pushed down against its elasticity, while the resultant repulsion force gradually increases a push-back force to push back the male connector 52 in the anti-fitting direction (that is, in the opposite direction to the fitting direction).

And, as the connector fitting operation advances as shown in FIG. 12, the securing projection 61 penetrates under the lower surface of the slide plate 65 to thereby flex the lock arm 60 downward. Also, while being contacted with the spring contact portion 64, the leading end portion of the resilient piece 58 gradually presses against the male connector 52 in the anti-fitting direction. In this stage, in case where the fitting force is eased, the male and female connectors 52 and 53 are separated from each other, thereby being able to prevent the imperfect fit between them.

Further, in case where the connector fitting operation advances as shown in FIG. 13, when the securing projection 61 passes through under the lower surface of the slide plate 65 and is then secured to the securing groove 66, the resilient piece 58 is sufficiently pushed down to thereby enter under the lower surface of the housing 54, so that the male and female connectors 52 and 53 are perfectly fitted with each other. At the then time, although the energizing force thereof to push up the male connector 52 is large, since the resilient piece 58 is inclined almost horizontally, the component of the force to push back the male connector 52 in the anti-fitting direction is negligible.

Further, to remove the connector fitted state, in case where the pressing parts 62 are pressed down with fingers, the lock arm 60 is flexed and the securing projection 61 is thereby removed from the securing groove 66; and, therefore, in case where the housings 54 and 55 of the male and female connectors 52 and 53 are pulled in the separating direction, they can be easily separated from each other. At the then time, since the resilient piece 58 holding the repulsion force is contacted with the leading end portion of the spring contact portion 64, the fit removing force can be increased.

However, in the above-mentioned conventional half fit preventive connector 51, in the perfectly fitted state, the resilient piece 58 including the support arm 57 of the spring member 56 is always pushing up the male connector 52 while the resilient piece 58 remains flexed. This raises a problem that the male connector 52 can be damaged and the spring member 56 can be fatigued.

SUMMARY OF THE INVENTION

The present invention aims at eliminating the above problem found in the conventional half fit preventive connector. Accordingly, it is an object of the invention to provide a highly reliable half fit preventive connector which, in the perfectly fitted state, not only can prevent the connector against damage but also can prevent the spring member from being fatigued.

In attaining the above object, according to the invention, there is provided a half fit preventive connector comprising:

a set of male and female connector to be fitted and connected with each other; a spring member accommodated within the one connector, the spring member provided with a resilient piece supported on a support arm rotatable in the axial direction of the one connector and an elastic flexible part for urging the support arm so as to rotate in the axial direction of the one connector; a securing groove formed on the upper surface of the one connector; a lock arm formed on the upper surface of the other connector, provided with a securing projection disposed on an intermediate portion thereof and a pressing part formed on the rear end portion thereof; a spring contact projection provided on a front end portion in a side surface of the other connector; and an escape space formed in rear side of the spring contact projection; wherein the resilient piece urges the other connector in the opposite direction to the connector fitting direction when the one and other connectors are half fitted with each other, and the resilient piece returns back to its free state through the escape space and the securing projection on the lock arm is secured by the securing groove of the one connector when the male and female connectors are perfectly fitted with each other.

Further, in the above half fit preventive connector, preferably, the spring member may include a mounting arm which can be mounted onto the one connector.

According to the above-structured half fit preventive connector, on the front end portion of the side surface of the other connector housing, there is disposed a spring contact projection including in the rear portion thereof an escape space on which the resilient piece can slide when the male and female connectors are half fitted with each other and also through which the resilient piece can return back to its free state when the male and female connectors are perfectly fitted with each other.

Therefore, in the connector perfectly fitted state, the spring member is held in its free state, which not only can prevent the spring member from being fatigued but also can prevent the connector against damage, thereby being able to enhance the reliability of the connector.

Also, in case where the spring member includes, on one end of an elastically flexible part thereof, the resilient piece supported laterally on the support arm rotatable in both of connector fitting and anti-fitting directions and, on the other end of the elastic flexible part, a mounting arm which can be mounted onto the other connector housing, only the resilient piece can be contacted with the spring contact projection with no interference by the support arm.

Therefore, since the spring member can be returned back to its free state while dodging the spring contact projection, the spring member can be held in its free state in both of the connector perfectly fitte[0084] stat[0085] and connector fit removed state using a simple structure. Thus, the efficiency of the connector fitting operation can be enhanced.

DETAILED DESCRIPTION OF THE PREFERRED EMBODIMENTS

Figure 1:
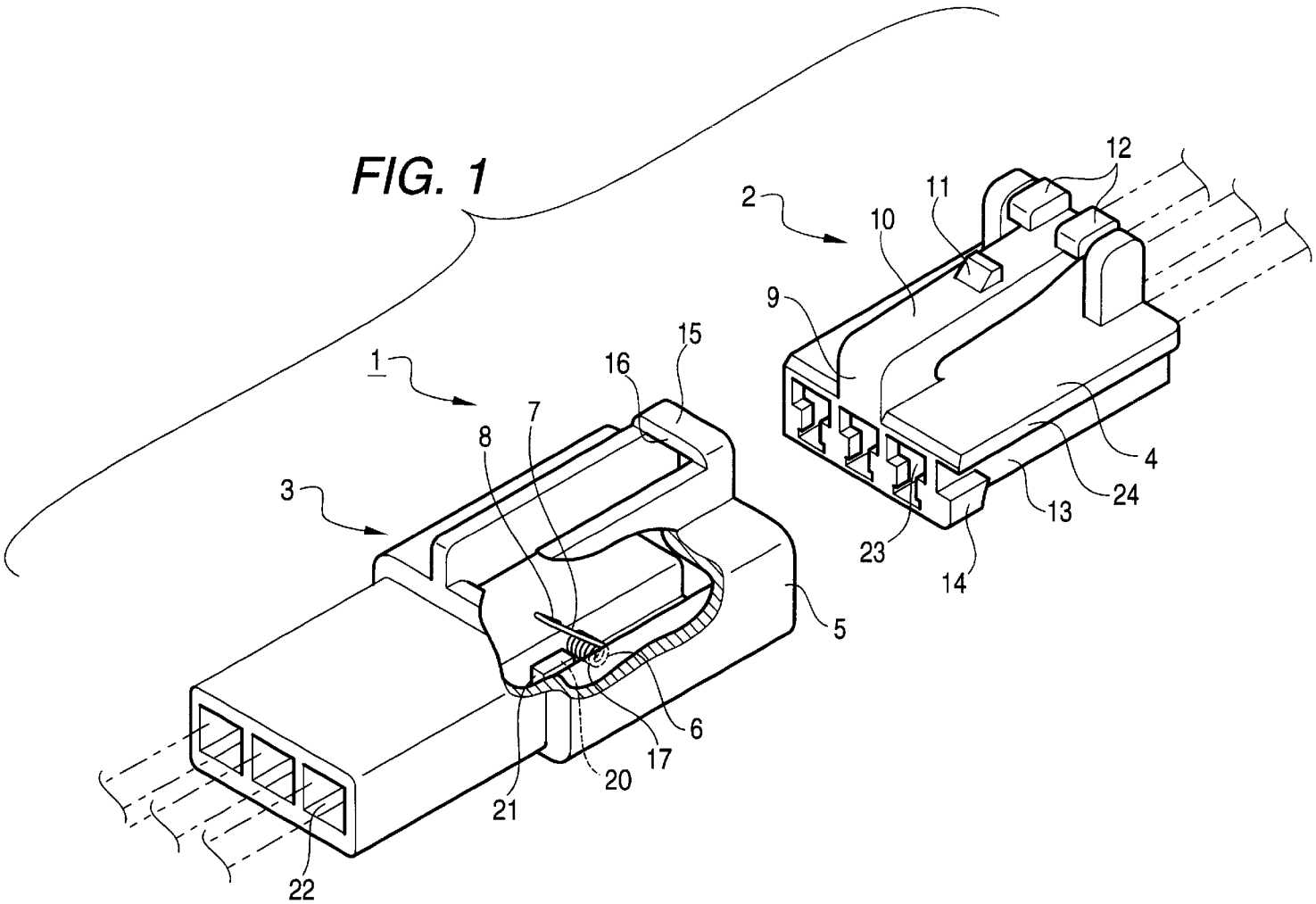
FIG. 1 is a perspective view of an embodiment of a half fit preventive connector according to the invention.
Figure 2:
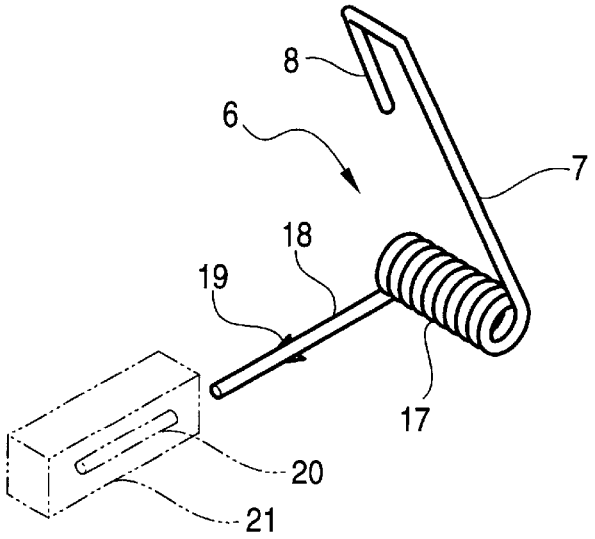
FIG. 2 is an enlarged perspective view of a spring member shown in FIG. 1.
Figure 3:
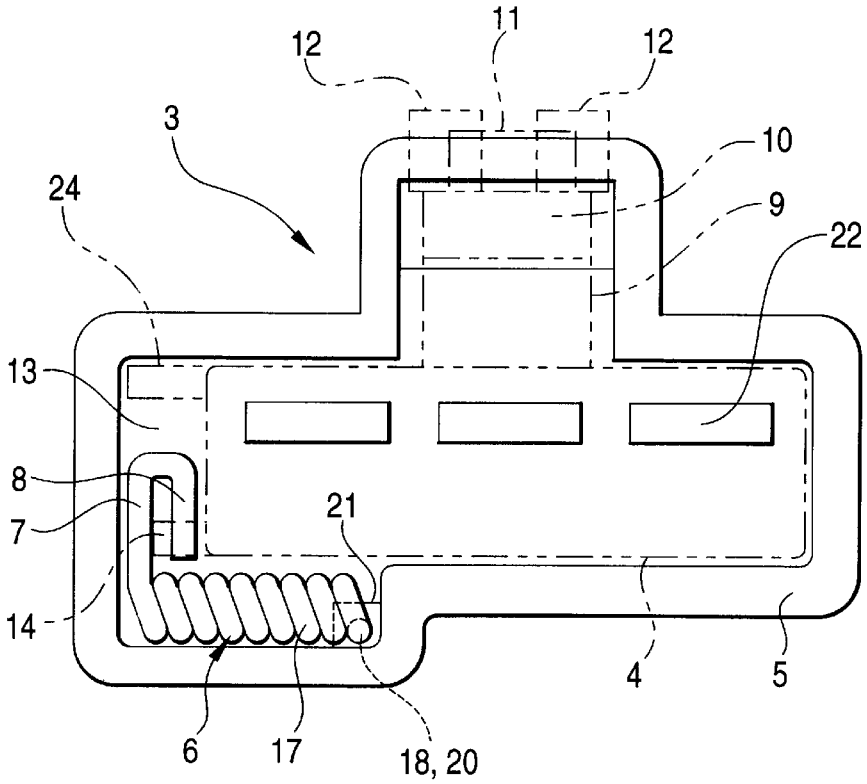
FIG. 3 is a front view of a female connector shown in FIG.
Figure 4:
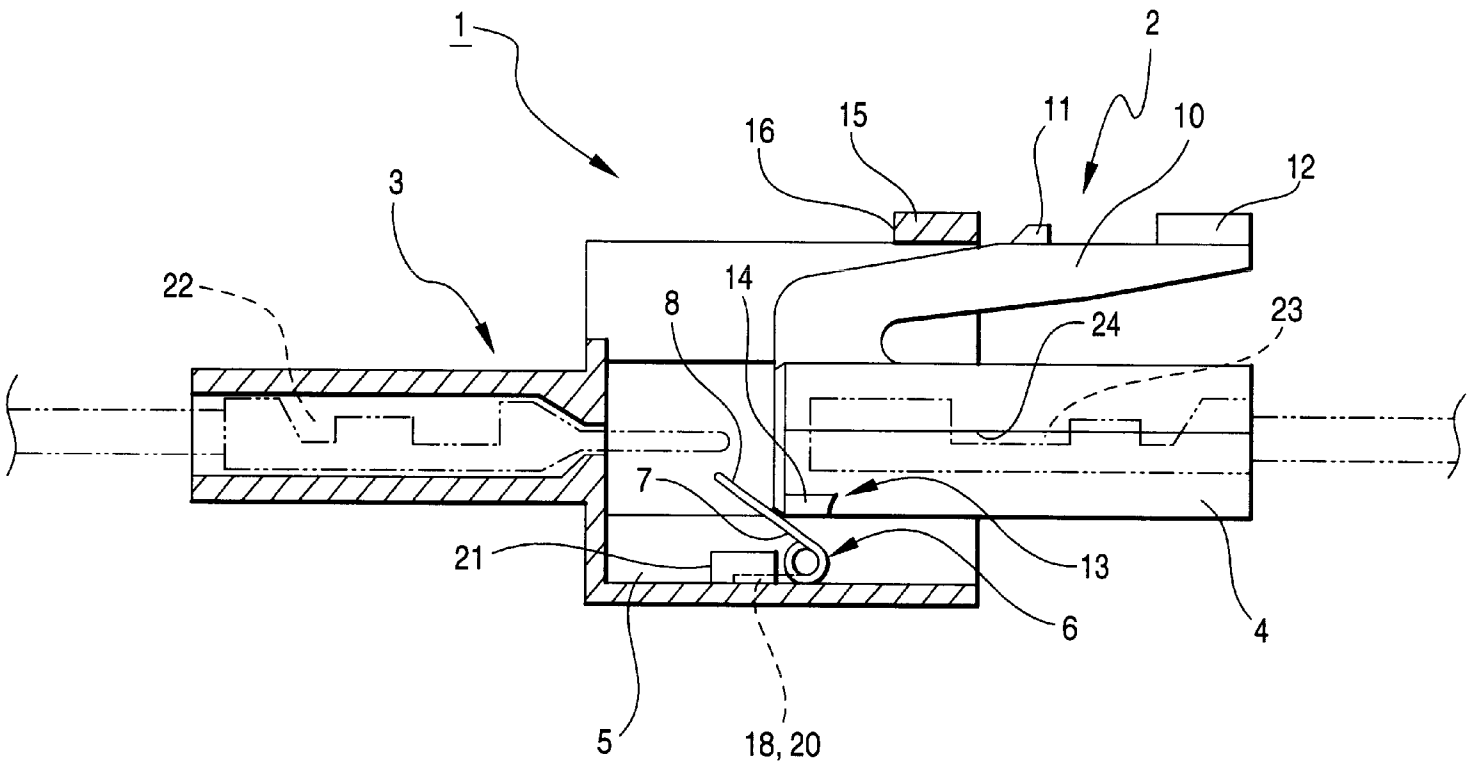
FIG. 4 is an explanatory view of the operation of the half fit preventive connector shown in FIG. 1, showing a fitting operation starting state thereof.
Figure 5:
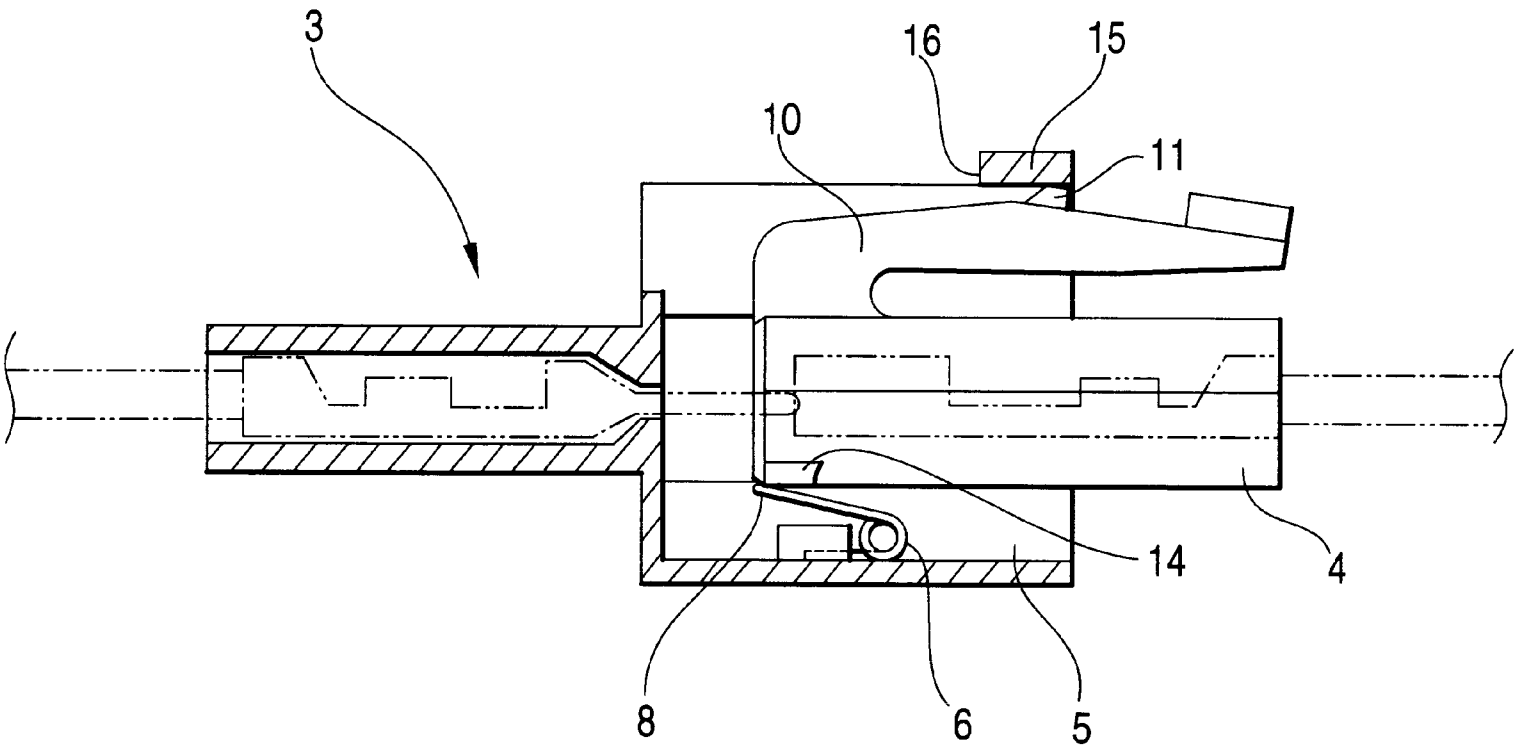
FIG. 5 is an explanatory view of the operation of the half fit preventive connector shown in FIG. 1, showing a fitting operation intermediate state thereof.
Figure 6:
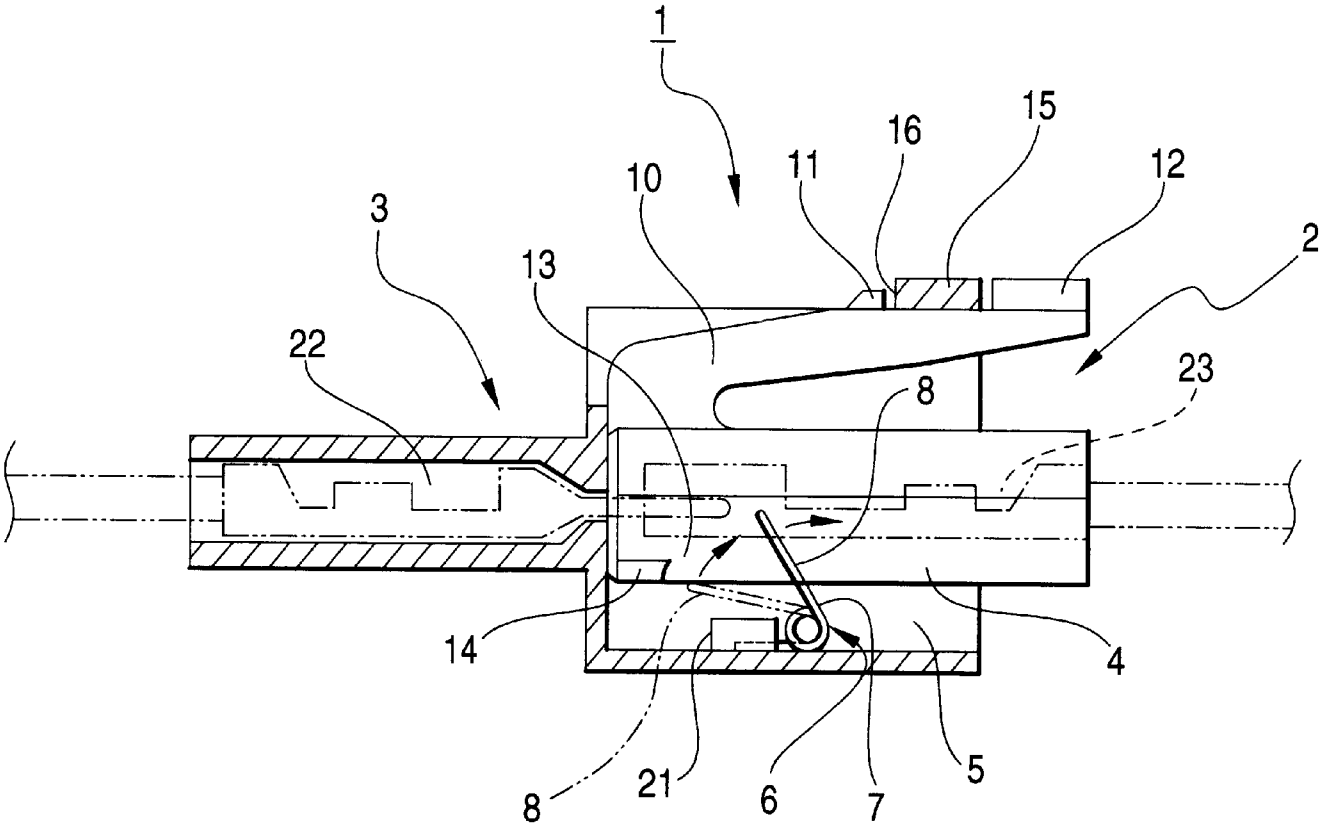
FIG. 6 is an explanatory view of the operation of the half fit preventive connector shown in FIG. 1, showing a perfectly fitted state thereof.
Figure 7:
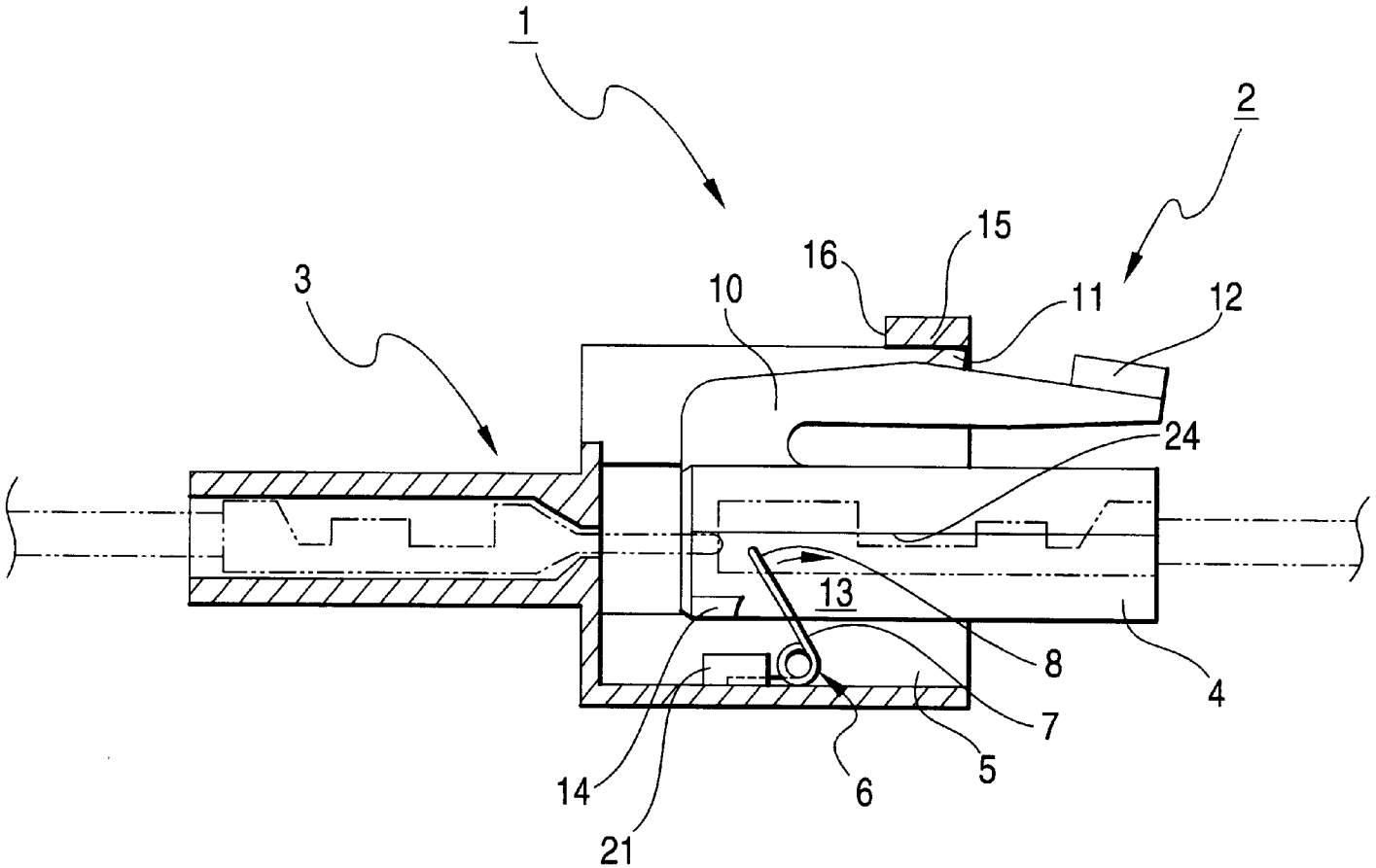
FIG. 7 is an explanatory view of the operation of the half fit preventive connector, showing how to remove the perfectly fitted state shown in FIG. 6.
Figure 8:
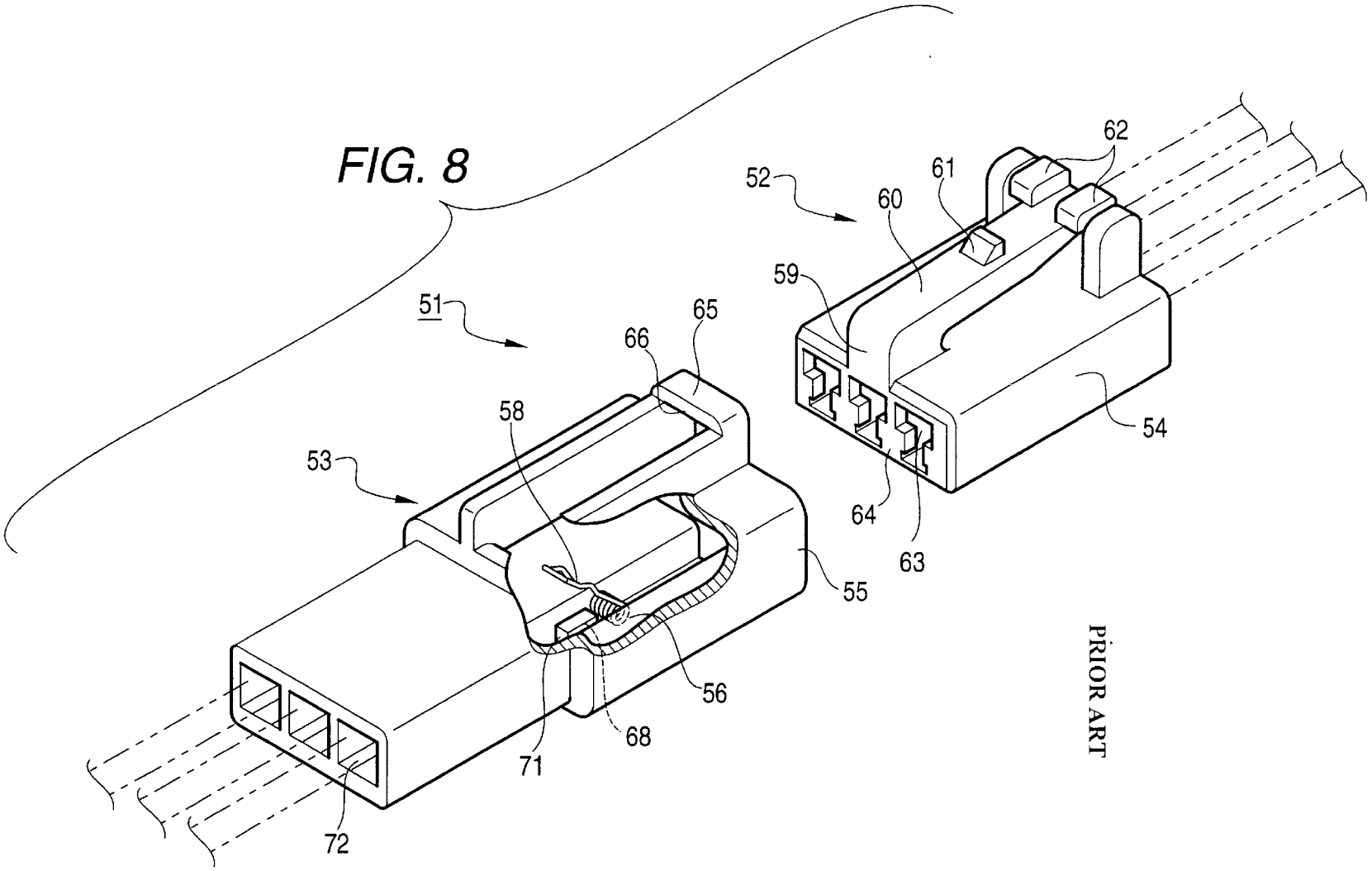
PRIOR ART FIG. 8
FIG. 8 is a perspective view of an example of a conventional half fit preventive connector.
Figure 9:
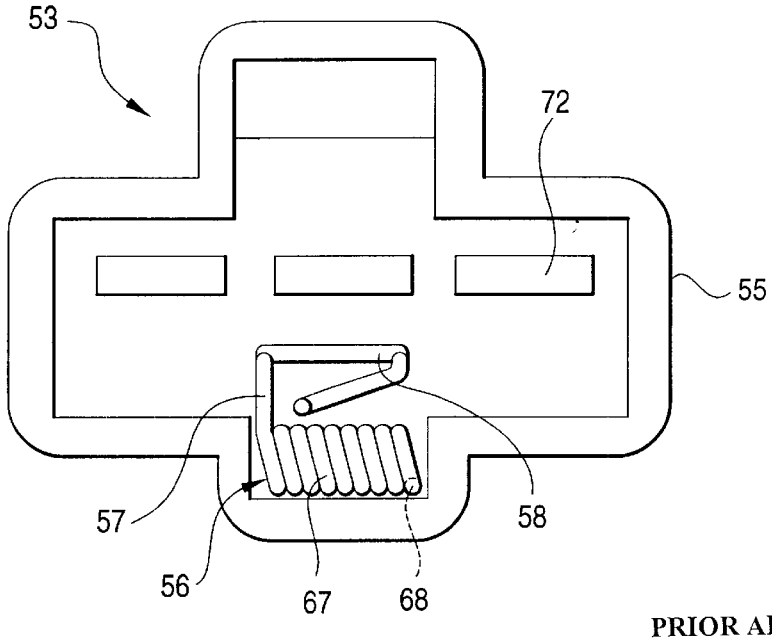
FIG. 9 is a front view of a female connector shown in FIG. 8.
Figure 10:
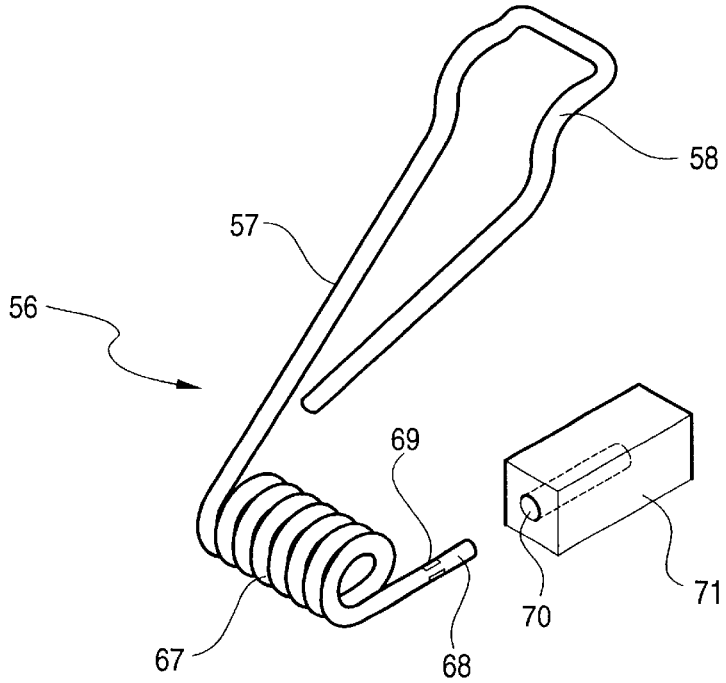
PRIOR ART FIG. 10
FIG. 10 is an enlarged perspective view of a spring member shown in FIG. 8.
Figure 11:
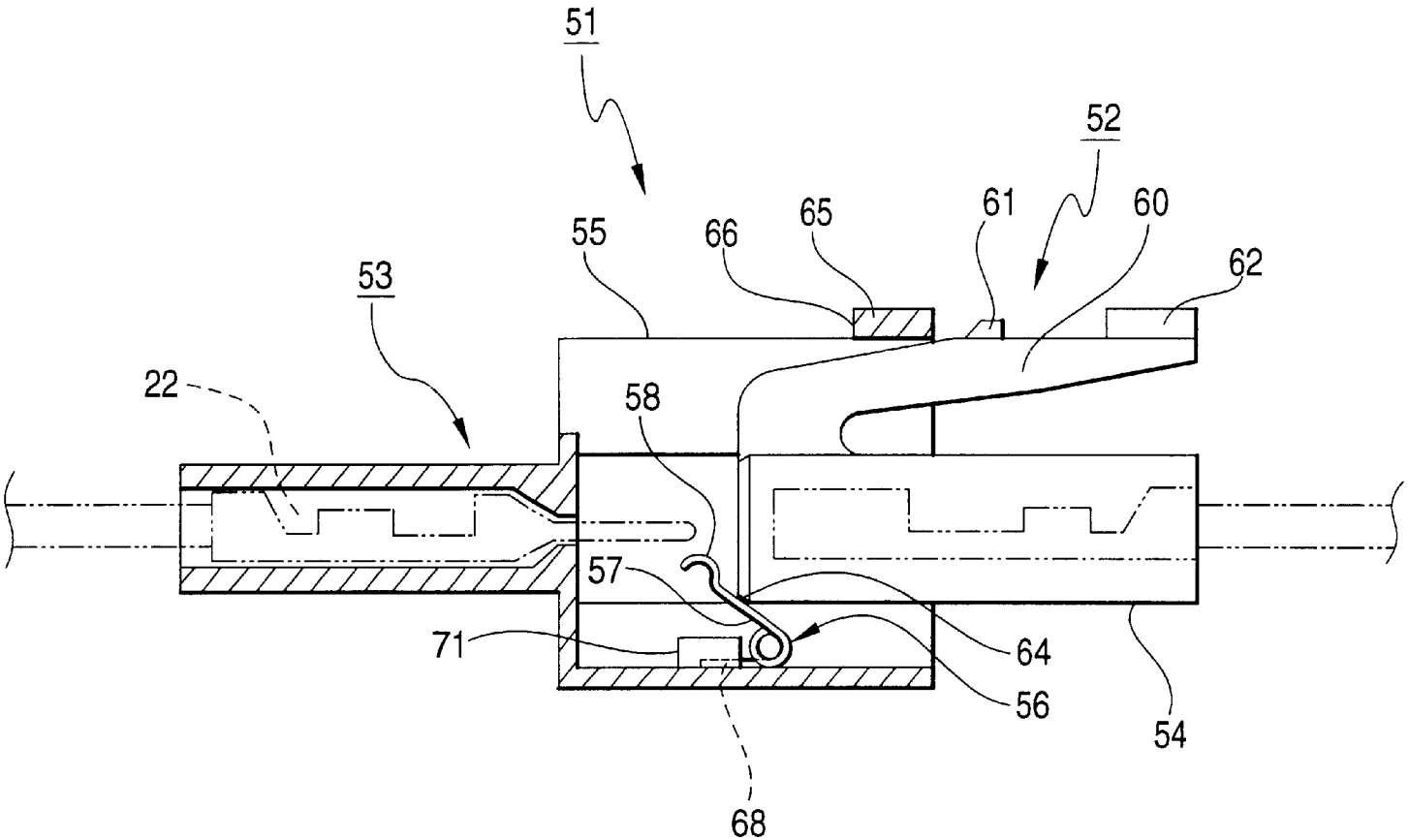
FIG. 11 is an explanatory view of the operation of the conventional half fit preventive connector shown in FIG. 8, showing a fitting operation starting state thereof.
Figure 12:
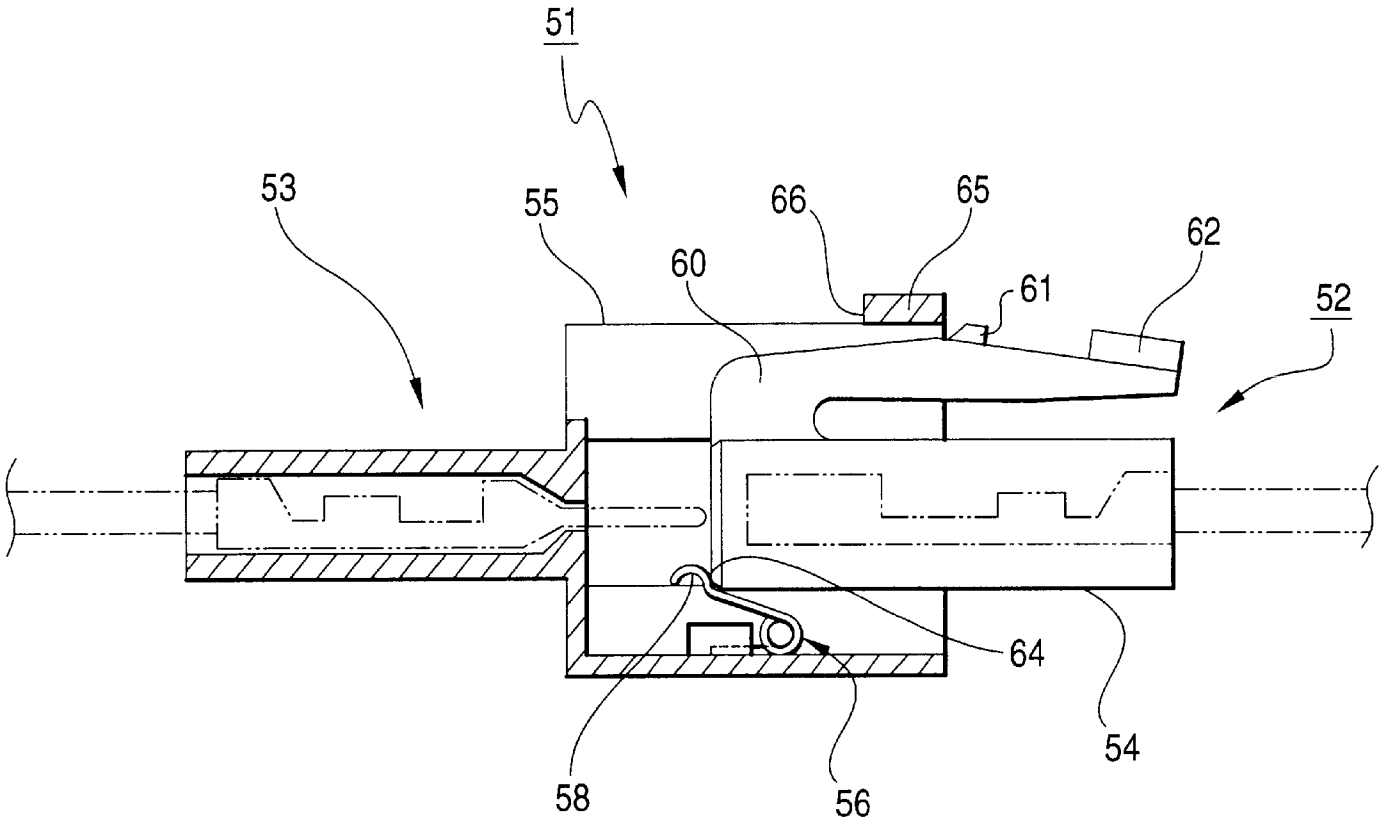
FIG. 12 is an explanatory view of the operation of the conventional half fit preventive connector shown in FIG. 8, showing a fitting operation intermediate state thereof; and, FIG. 13 is an explanatory view of the operation of the conventional half fit preventive connector shown in FIG. 8, showing a perfectly fitted state thereof.
Figure 13:
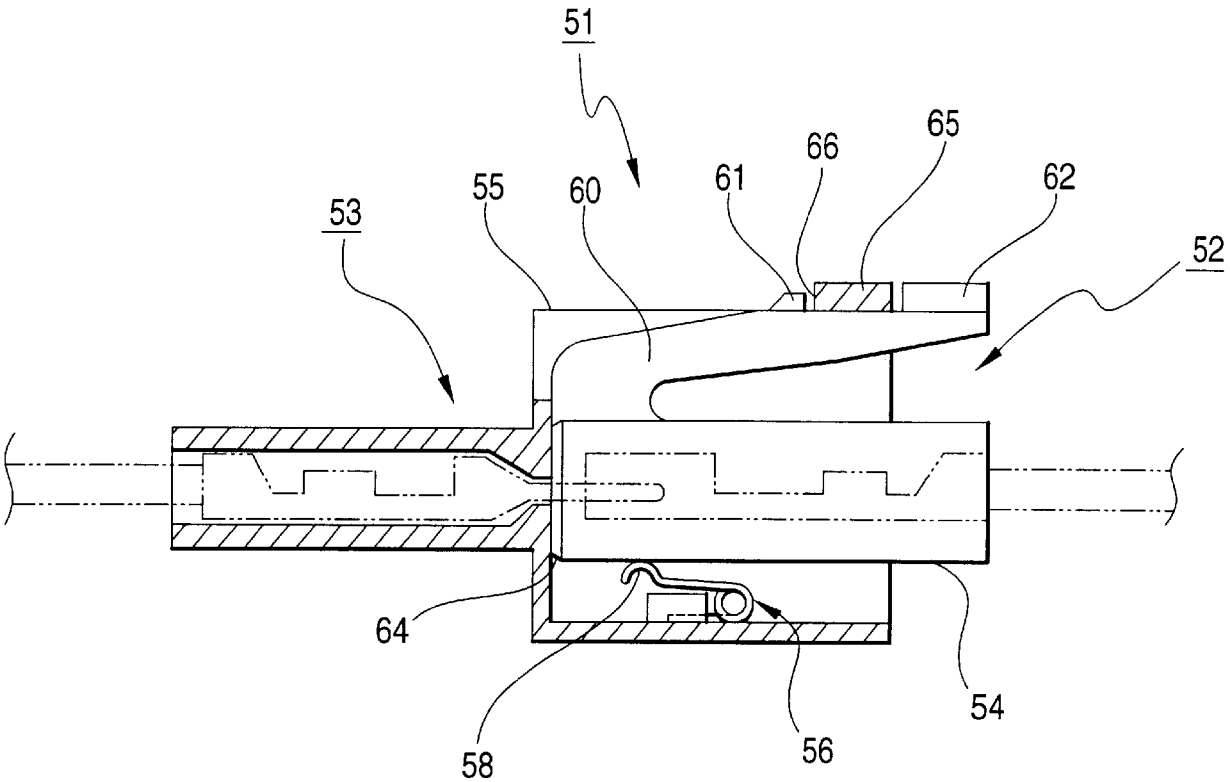

Now, description will be given below in detail of an embodiment of a half fit preventive connector according to the invention with reference to FIGS. 1 to 7. Here, FIG. 1 is a perspective view of an embodiment of a half fit preventive connector according to the invention; FIG. 2 is an enlarged perspective view of a spring member shown in FIG. 1; FIG. 3 is a front view of a female connector shown in FIG. 1; FIG. 4 is an explanatory view of the operation of the half fit preventive connector shown in FIG. 1, showing a fitting operation starting state thereof; FIG. 5 is an explanatory view of the operation of the half fit preventive connector shown in FIG. 1, showing a fitting operation intermediate state thereof; FIG. 6 is an explanatory view of the operation of the half fit preventive connector shown in FIG. 1, showing a perfectly fitted state thereof; and, FIG. 7 is an explanatory view of the operation of the half fit preventive connector, showing how to remove the perfectly fitted state shown in FIG. 6.

As shown in FIGS. 1 to 3, a spring member 6 is mounted in a half fit preventive connector 1 according to the present embodiment, a housing 5 of one connector between a pair of male and female connectors 2 and 3 to be fitted and connected with each other. The repulsion force of this spring member 6 is able to prevent the male and female connectors 2 and 3 from being imperfectly fitted with each other. This spring member 6 includes a support arm 7 which can be rotated in the connector fitting direction and, on the free end portion of the support arm 7, there is disposed a resilient piece 8.

Also, a lock arm 10, having a securing projection 11 provided on the middle of the upper portion thereof and a pair of pressing parts 12 provided on the rear end portion thereof, and supported by a support pillar 9 provided on the leading end portion of the other housing 4 by cooperating with the spring member 6, is flexed when fitting the male and female connectors 2 and 3 with each other. As a result, a securing projection 11 formed on the housing 5 is secured in a securing groove 16. The securing groove 16 is provided at in the rear end portion of a slide plate 15, which is supported on the upper portion of the front end of one housing 5 and allows the securing projection 11 to slide on the lower surface thereof.

Also, as shown in FIGS. 2 and 3, the spring member 6 comprises, as a base portion thereof, an elastic flexible part 17 consisting of a coiled spring and further includes the above-mentioned support arm 7 which is extended obliquely backward in a linear manner from one end portion of the elastic flexible part 17. Further, there is formed a resilient piece 8 in the leading end portion of the support arm 7 in such a manner that the leading end portion of the support arm 7 is bent in crank shape so as to return direction and to be laterally displaced. Further, the spring member 6 is provided with a reversed-pawl-shaped projection 19 serving as removal preventive means and a mounting arm 18 which is extended backward in a linear manner from the other end portion of the spring member 6.

The mounting arm 18 can be inserted into a mounting hole 20 formed in a mounting part 21 disposed within the housing 5 and can be mounted there in such a manner that the reversed-pawl-shaped projection 19 prevents the same against removal from the mounting hole 20. By the way, in the rear portion of one housing 5, there is formed a terminal storage chamber 22 for storing a terminal such as a male-type terminal; and, in the rear portion of the other housing 4, there is formed a terminal storage chamber 23 for storing a terminal such as a female-type terminal.

And, on one side surface of the lower portion of the front end of the other housing 4, there is disposed a spring contact projection 14 including in the rear portion thereof an escape space on which the resilient piece 8 is slid able when the male and female connectors 2 and 3 are half fitted with each other and also through which the resilient piece 8 can return back to its free state when the male and female connectors 2 and 3 are perfectly fitted with each other. Above the spring contact projection 14 and escape space 13, there is disposed a guide fin 24 extending in the axial direction. The guide fin 24 serves as a guide member when the male and female connectors 2 and 3 are fitted with each other.

In the half fit preventive connector 1 having the above structure, as shown in FIG. 4, after the spring member 6 is firstly mounted into the mounting part 21 within one housing 5, a male-type terminal with the end portion of a covered electric wire connected to the rear portion thereof is mounted into the terminal storage chamber 22. Also, a female-type terminal with the end portion of a covered electric wire connected to the rear portion thereof is mounted into the terminal storage chamber 23 within the other housing 4.

Next, in case where the male and female connectors 2 and 3 are disposed opposed to each other and the fitting operation thereof is started, the other housing 4 is fitted into one houing 5 and, at the same time, the resilient piece 8 of the spring member 6 is contacted with the spring contact projection 14 of the other housing 4. Therefore, the resilient piece 8 is pushed down together with the support arm 7 to thereby increase the force to push back the male connector 2 in the anti-fitting direction.

Next, in case where the connecting fitting operation advances in such a manner as shown in FIG. 5, the securing projection 11 penetrates under the lower surface of the slide plate 15 to thereby cause the lock arm 10 to flex downward. Also, the leading end of the resilient piece 8 is strongly pressed against the spring contact projection 14 in the anti-fitting direction. In this stage, in case where the fitting force is eased, the male and female connectors 2 and 3 are separated from each other, thereby being able to prevent the male and female connectors 2 and 3 from being imperfectly fitted with each other.

And, in case where the connecting fitting operation advances in such a manner as shown in FIG. 6 and the securing projection 11 is secured to the securing groove 16, the resilient piece 8 is pushed down sufficiently to thereby penetrate under the lower surface of the spring contact projection 14, so that the male and female connectors 2 and 3 are perfectly fitted with each other. At the then time, the leading end portion of the resilient piece 8 bounces up within the escape space 13 spreading out over the rear surface of the spring contact projection 14, with the result that the spring member 6 returns back to its free state.

Next, to remove the connector fitted state, as shown in FIG. 7, in case where the pressing parts 12 are pressed down with fingers, the lock arm 10 is flexed and the securing projection 11 is thereby removed from the securing groove 16; and, therefore, the male and female connectors 2 and 3 may be respectively pulled in their separating directions. At the then time, as shown in FIG. 3, the resilient piece 8 is contacted with the rear surface of the spring contact projection 14 and is rotated backward; and, after then, it passes through the upper surface of the spring contact projection 14 a and is thereby removed from its contact with the spring contact projection 14.

As described above, in the half fit preventive connector according to the present embodiment, on the front end portion of the side surface of the other housing 4, there is disposed the spring contact projection 14 including in the rear portion thereof the escape space 13 on which the resilient piece 8 can slide when the male and female connectors 2 and 3 are half fitted with each other and also through which the resilient piece 8 can return back its free state when the male and female connectors 2 and 3 are perfectly fitted with each other. Therefore, in the connector perfect fit state, since the spring member 6 returns to its free state, fatigue of the spring member 6 as well as damage of the male and female connectors 2 and 3 can be prevented. Consequently the reliability of the connector is enhanced.

Also, as described above, the spring member 6 is structured in the following manner: that is, in one end of the elastic flexible part 17, there is disposed the support arm 7 which can be rotated in both of fitting and anti-fitting directions, and on the free end portion of the support arm 7, there is supported the resilient piece 8 in such a manner that it is displaced laterally or inwardly from the support arm 7;

and, on the other end of the elastic flexible part 17, there is disposed the mounting arm 18 which can be mounted onto one housing 5.

That is, since only the resilient piece 8 can be contacted with the spring contact projection 14 without interference by the support arm 7, in the connector fit removing operation, the spring member 6 can be returned back to its free state while dodging the spring contact projection 14. Thus, the spring member 6 can be held in its free state in both of the connector perfectly fitted state and connector fit removed state with a simple structure, so that the efficiency of the connector fitting operation can be enhanced as well as the cost of the half fit preventive connector can be reduced.

By the way, the invention is not limited to the abovementioned embodiment but the invention can also be enforced by another embodiment in which the illustrated embodiment is changed or modified properly. For example, although the elastic flexible part 17 of the spring member 6 is formed of a coiled spring in the illustrated embodiment, the elastic flexible part 17 may also be composed of a torsion-bar-type rod the central portion of which is narrowed. Also, in FIGS. 1 and 3, the spring member 6 and spring contact projection 14 are respectively disposed on one side but they may also be disposed on both sides from the viewpoint of balance of power.

Further, although the resilient piece 8 of the spring member 6 is formed in such a manner that the leading portion of support arm 7 is bent in crank shape so as to return direction and to be laterally displaced in the above embodiment, the resilient piece 8 is not limited such the structure. That is, for example, the resilient piece can be provided separately and then attached to the support arm. The shape of resilient can be formed in any shape so long as to be suitable for the contact with the spring contact projection.

As has been described heretofore, according to the half fit preventive connector of the invention, on the front end portion of the side surface of the other housing, there is disposed the spring contact projection including in the rear portion thereof the escape space on which the resilient piece can slide when the male and female connectors are half fitted with each other and also through which the resilient piece can return back its free state when the male and female connectors are perfectly fitted with each other.

Therefore, since the spring member returns to its free state in the connector perfect fit state, fatigue of the spring member as well as damage of the half fit preventive connector can be prevented, so that the reliability of the connector is enhanced.

Also, in the present half fit preventive connector, in case where the spring member is structured such that, on one end of the elastic flexible part, there is disposed the resilient piece supported laterally on the support arm which can be rotated in both of fitting and anti-fitting directions and, on the other end of the elastic flexible part, there is disposed the mounting arm which can be mounted onto one housing, only the resilient piece can be contacted with the spring contact projection without interference by the support arm.

Therefore, in the connector fit removing operation, the spring member can be returned back to its free state while dodging the spring contact projection. Thus, the spring member can be held in its free state in both of the connector perfectly fitted state and connector fit removed state with a simple structure, so that the efficiency of the connector fitting operation can be enhanced.

What is claimed is:

1. A half fit preventive connector comprising:

a first connector;

a spring member accommodated within said first connector, said spring member provided with a resilient piece supported on a support arm rotatable in the axial direction of said first connector and an elastic flexible part for urging said support arm so as to rotate in the axial direction of said first connector;

a securing groove formed on the upper surface of said first connector;

a second connector to be fitted and connected with said first connector;

a lock arm formed on the upper surface of said second connector, provided with a securing projection disposed on an intermediate portion thereof and a pressing part formed on the rear end portion thereof;

a spring contact projection provided on a front end portion in a side surface of said second connector; and an escape space formed in rear side of said spring contact projection;

wherein said resilient piece urges said second connector in the opposite direction to the connector fitting direction when said first and second connectors are half fitted with each other, and said resilient piece returns back to its free state through said escape space and said securing projection on said lock arm is secured by said securing groove of said first connector when said first and second connectors are perfectly fitted with each other.

2. A half fit preventive connector according to claim 1, wherein said spring member further comprises a mounting arm provided on an end of said elastic flexible part, and said mounting arm is mounted in said second connector, so that said spring member is supported on said second connector.

3. A half fit preventive connector according to claim 1, wherein said elastic flexible part is constituted by a coiled spring.

* * * * *